US009556709B2

(12) United States Patent
Parman

(10) Patent No.: US 9,556,709 B2
(45) Date of Patent: Jan. 31, 2017

(54) SKIN EFFECT HEATING SYSTEM HAVING IMPROVED HEAT TRANSFER AND WIRE SUPPORT CHARACTERISTICS

(75) Inventor: David G. Parman, San Ramon, CA (US)

(73) Assignee: Pentair Thermal Management LLC, Menlo Park, CA (US)

( * ) Notice: Subject to any disclaimer, the term of this patent is extended or adjusted under 35 U.S.C. 154(b) by 785 days.

(21) Appl. No.: 13/121,296

(22) PCT Filed: Sep. 23, 2008

(86) PCT No.: PCT/US2008/077347

§ 371 (c)(1),
(2), (4) Date: Apr. 18, 2011

(87) PCT Pub. No.: WO2009/042575

PCT Pub. Date: Apr. 2, 2009

(65) Prior Publication Data

US 2011/0233192 A1 Sep. 29, 2011

Related U.S. Application Data

(60) Provisional application No. 60/975,196, filed on Sep. 26, 2007.

(51) Int. Cl.
*E21B 36/04* (2006.01)

(52) U.S. Cl.
CPC ..... *E21B 36/04* (2013.01); *Y10T 29/49826* (2015.01)

(58) Field of Classification Search
CPC ..... E21B 36/04; Y10T 29/49826
USPC ..... 219/548, 549, 552, 553, 537, 538, 544,219/546
See application file for complete search history.

(56) References Cited

U.S. PATENT DOCUMENTS

| | | | | |
|---|---|---|---|---|
| 3,732,352 | A * | 5/1973 | Dima et al. | 174/10 |
| 3,980,808 | A * | 9/1976 | Kikuchi et al. | 174/110 SR |
| 4,101,727 | A * | 7/1978 | Levitov et al. | 174/28 |
| 4,219,742 | A * | 8/1980 | Ponder | 307/147 |
| 4,291,192 | A * | 9/1981 | Eccleston et al. | 174/11 BH |
| 4,523,648 | A * | 6/1985 | Strada et al. | 174/26 R |
| 4,645,906 | A * | 2/1987 | Yagnik et al. | 392/469 |
| 4,837,751 | A * | 6/1989 | Kruka et al. | 367/154 |
| 4,994,632 | A * | 2/1991 | Bosisio et al. | 174/121 R |
| 5,060,287 | A * | 10/1991 | Van Egmond | 392/301 |
| 5,714,715 | A * | 2/1998 | Sundhararajan et al. | 174/20 |
| 5,875,283 | A * | 2/1999 | Yane et al. | 392/497 |
| 5,888,083 | A * | 3/1999 | Seilhan et al. | 439/161 |
| 5,974,226 | A * | 10/1999 | Shaffer | 392/301 |
| 6,050,855 | A * | 4/2000 | Varreng et al. | 439/607.51 |
| 2002/0023751 | A1* | 2/2002 | Neuroth | E21B 23/14 166/302 |
| 2004/0149443 | A1* | 8/2004 | La Rovere | E21B 33/14 166/302 |

(Continued)

*Primary Examiner* — David Angwin
*Assistant Examiner* — Amit K Singh
(74) *Attorney, Agent, or Firm* — Quarles & Brady LLP

(57) ABSTRACT

A skin effect heating cable used to form a heat tracing circuit for heating a production pipe carrying process media. The skin effect heating cable includes a heating tube which includes a conductor, an insulating layer wrapped around the conductor and a dielectric fluid disposed between the insulating layer and the inner wall of the heating tube. The dielectric fluid increases the heat transfer characteristic from the conductor to the heating tube while providing mechanical load relief to the cable.

15 Claims, 3 Drawing Sheets

(56) References Cited

U.S. PATENT DOCUMENTS

2007/0127897 A1* 6/2007 John et al. ..... 392/301

* cited by examiner

SKIN EFFECT HEATING SYSTEM HAVING IMPROVED HEAT TRANSFER AND WIRE SUPPORT CHARACTERISTICS

FIELD OF THE INVENTION

Embodiments of the invention relate to the field of heat tracing systems. More particularly, embodiments of the invention relate to a skin effect heating system and method having improved heat transfer characteristics and an associated support configuration.

DISCUSSION OF RELATED ART

Heating systems are employed to facilitate the extraction of oil, gas and similar media from subterranean environments. For example, heating systems are used to prevent production losses resulting from paraffin deposits and hydrate formation in the extraction production tube as well as improving production of heavy oils by lowering the viscosity to provide better flow applications. One way to facilitate the heating of production pipes through which the media, such as oil, is extracted is to employ a heat tracing system. Electrical heat tracing systems are typically used in various industries including oil and gas, but may also be used in power, food and beverage, chemical and water industries. In these systems, a heating cable is connected or wrapped around a production or process pipe and power is supplied to the cable to form a heat tracing circuit.

One type of pipe employed in heat tracing systems is a skin effect heat tracing pipe. Skin effect heat tracing pipes are preferred in many different pipeline environments, including downhole or wellbore heating associated with oil extraction. When this type of pipe is employed, the inner surface of a ferromagnetic pipe or tube is electrically energized (AC voltage) and an insulated, non-ferromagnetic return conductor is used to complete the circuit. The inner surface of the pipe carries full current and heats up, but the outer surface remains at ground potential. The path of the circuit current is pulled to the inner surface of the heat tube by both the skin effect and the proximity effect between the heat tube and the conductor. The skin effect circuit impedance is mainly resistive, thereby generating heat in the tube wall and, to a lesser extent, in the insulated conductor. Additional heat transfer results from eddy currents induced in the tube wall by the current flow through the conductor. These eddy currents are the result of the changing magnetic field due to variations of the field over time which causes a current within the conductor. In this manner, the skin effect pipes are in contact with the outer surface of the delivery conduit and thermal conduction is used to transfer the heat from the skin effect pipe to the delivery conduit and consequently to the process media.

The size and depth of the skin effect heating system depends on the length of the circuit within the subterranean application, the power output of the circuit, the tube and conductor size as well as the process media pipe temperature. All of these factors contribute to the efficiency and effectiveness of the heating system. However, a drawback associated with these systems is that the heat transfer from the conductor to the conduit or tube results in high conductor temperatures, thereby limiting the overall power supplied by the heat tracing system. In addition, the mechanical tension on the heat tracing cable within the conduit or tube, which increases with subterranean depth due to gravitational forces, may compromise the integrity of the heating cable. Thus, there is a need for a skin effect heating system which provides improved heat transfer to the tube or conduit from the conductor and a tension management system which maintains the integrity of the cable within the wellbore.

SUMMARY OF THE INVENTION

Exemplary embodiments of the present invention are directed to a skin effect heat tracing system with improved heat transfer characteristics and an associated support configuration. In an exemplary embodiment, the skin effect heat tracing cable is positioned along a production pipe carrying process media and includes a heating tube, a conductor, an insulating jacket and a dielectric fluid. The heating tube is in contact with the production pipe to transfer heat thereto. The conductor is disposed within the heating tube and is connected to a power supply to supply current to the conductor. The power supply is also connected to the heating tube to complete a heat tracing circuit with the conductor. The insulating layer or insulating jacket is positioned around the conductor and the dielectric fluid is disposed between the heating tube and the insulating layer.

DESCRIPTION OF EMBODIMENTS

Figure 1:
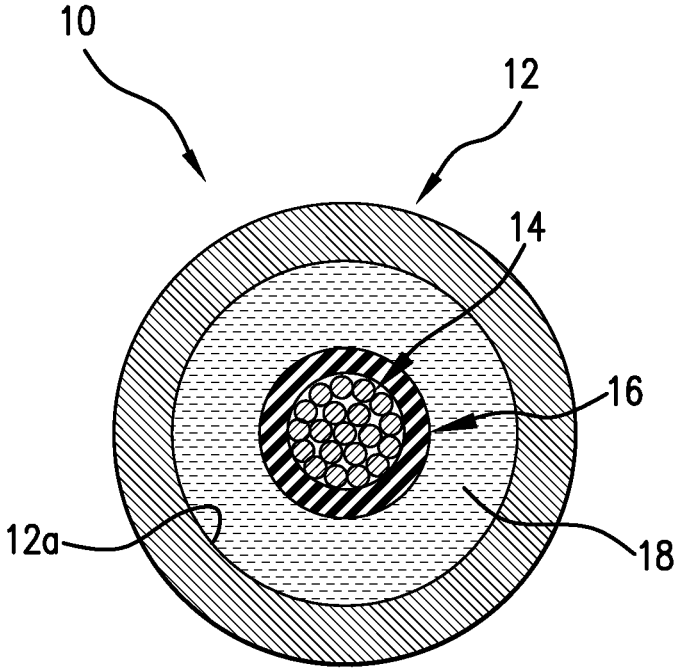
FIG. 1 is cross-sectional view of an exemplary embodiment of a heat tracing cable in accordance with the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a cross-sectional view of an exemplary embodiment of a skin effect heat tracing cable 10 in accordance with the present invention which includes a conduit or coiled tube 12, conductor 14, electrical insulation 16, and a dielectric fluid disposed between tube 12 and insulation 16. Heat tracing cable 10 may be used in various sub-sea and oilfield environments including bottom hole heating and reservoir stimulation, gas and water systems and other high pressure applications requiring skin effect heating cables. Conductor 14 is centrally positioned within the heat cable 10 and is comprised of a high strength conductor such as, for example, copper clad steel, high strength copper alloy, steel reinforced aluminum or other like material having sufficient strength and electrical conductivity. The conductor may be from about 0.25" to about 0.5" nominal dimensions, but can be larger or smaller depending on the particular application. Conductor 14 may be a solid conductor composed of multiple layers of different materials. Alternatively, conductor 14 may be a stranded conductor composed of different designs and compositions including, for example, copper, aluminum, ferromagnetic steel, stainless steel, nickel plated copper, and the preferred material being copper.

Conductor 14 is surrounded by insulating layer 16 having a thickness, for example of from about 0.060" to about 0.120" and more preferably from 0.080" to about 0.100" and capable of withstanding temperatures from about ≥100° C. Insulating layer 16 may be comprised of, for example, a cross linked polyethelene formulation, fluoropolymers and the like. For example, polyethylene formulations are particularly applicable for higher voltage applications, whereas fluoropolymers are particularly useful for high temperature applications.

Conduit or tube 12 may be, for example, a coiled ferromagnetic steel tube and is non-porous to contain dielectric fluid 18. Conduit 12 may also be any ferromagnetic heatable encasement configuration such as steel pipe, coiled tube, roll formed tube, etc., which is capable of withstanding elevated temperatures found in wellbore applications. The diameter size of conduit 12 is dependent on the particular wellbore application, but may be, for example, from about 3" outer diameter (O.D.) to about 0.5" O.D. and preferably from about 2" O.D. to about 1" O.D. Conduit 12 has an inner wall surface 12*a* and a wall thickness from about 0.1" to about 0.5".

A dielectric fluid layer 18 is disposed between insulating layer 16 and conduit 12. In particular, dielectric fluid is filled into cable 10 between insulating layer 16 and the inner wall 12*a* of tube 12. Dielectric layer 18 wraps around conductor 14 and is used to reduce the gravitational tension and/or compression loads in the conductor 14. The gravitational tension is reduced by decreasing the weight of the heating cable and thus the gravitational forces applied to the cable positioned within the well bore. In addition, dielectric fluid layer 18 also improves the heat transfer characteristic from conductor 14 to conduit 12, while improving the dielectric capabilities to the insulation 16. Dielectric fluid 18 improves the heat transfer characteristics by eliminating air from around insulation layer 16. This minimizes the risk of partial discharge (PD) which is a particular concern for fluoropolymer insulations. In this manner, by adding dielectric fluid 18, an increase voltage may be employed for use with high temperature insulating layer 16. Representative dielectric fluids 18 may include, for example, mineral oils, organic based transformer oils and similar materials capable of providing sufficient dielectric strength and thermal stability to further electrically insulate the conductor 14 from tube or conduit 12. Representative dielectric fluids include SHELL DIALA®Oil HFX sold by Shell Oil Company of Houston, Tex. (USA).

Figure 2:
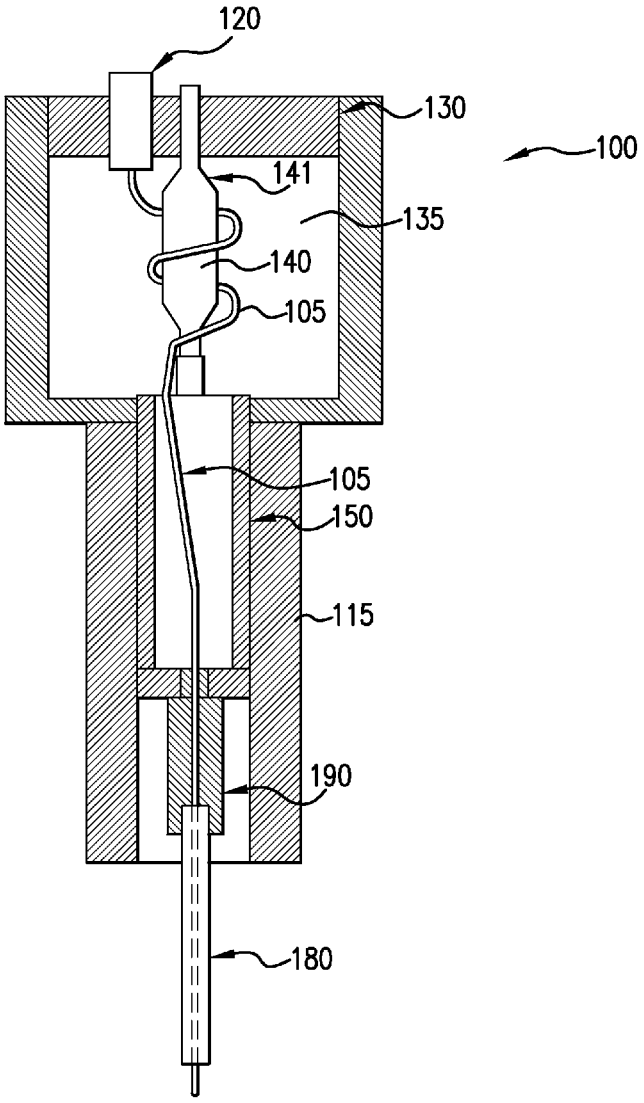
FIG. 2 is a block diagram longitudinal cross-sectional view of a heat tracing cable installed within a well in accordance with the present invention.

FIG. 2 generally illustrates an exemplary partial view of a downhole subterranean wellbore 100 having a well head section 110 and lower casing section 115. Wellhead section 110 includes a wellhead cap 130 and a wellhead cavity 135. The skin effect heating cable 105 is connected to one end of electrical penetrator power box 120 which provides AC power to the cable. Electrical penetrator box 120 extends through well head cap 130 and is connected at its other end to a power cable and transformer (not shown) at or near the surface of the well. Mandrel 140 is connected to, or extends through wellhead cap 130 for mechanical support for cable 105. Alternatively, mandrel 140 may also be located outside of wellhead section 110. Mandrel 140 is illustrated with a fishing neck portion 141, however a substantially cylindrical shaped mandrel may also be employed. Cable 105 is wrapped around mandrel 140 in wellhead section 110 to provide mechanical load relief to electrical penetrator 120 and cable 105 as it extends into the depths of wellbore 100. In particular, by wrapping cable 105 around mandrel 140, the gravitational forces and load of the cable is dispersed across the mandrel. A tube hanger 150 is disposed within casing 115 and is used to provide mechanical holding strength to heating tube 180. A standard tube connector 190 is disposed between tube hanger 150 and heating tube 180. Heating cable 105 extends down through wellhead cavity 135, tube hanger 150, tube connection 190 and heating tube 180. The heating tube 180 extends along the production tube (not shown) down the wellbore to provide a heat tracing circuit to heat the process media flowing through the production tube. The heater cable may not extend down the entire length of the production tube depending on the extraction application. In addition, the production tube may also be diverted away from the electrical penetrator as it approaches the wellhead through a series of valves and piping connections.

Figure 3:
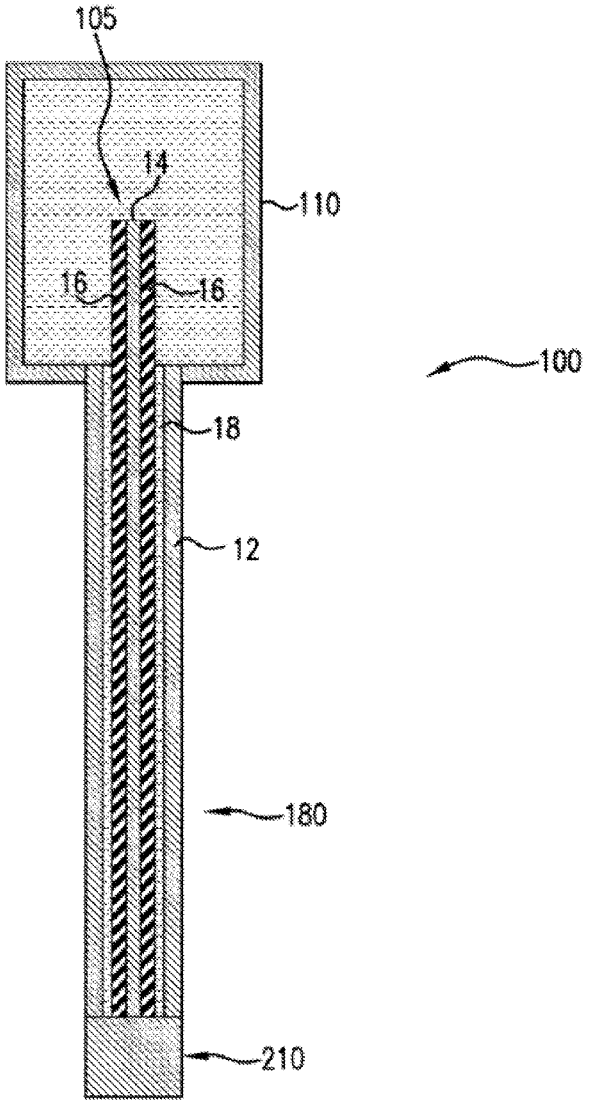
FIG. 3 is a longitudinal cross-sectional view of a heat tracing cable within a conduit or tube in accordance with the present invention.

FIG. 3 is a longitudinal cross-sectional view of a simplified wellbore to illustrate the use of heat tracing cable 105 in which the dielectric fluid 18 (shown in FIG. 1) is employed. In particular, wellhead section 110 receives skin effect heating cable 105 at one end which extends down into a portion of the wellbore by way of heating tube 180 along a production pipe carrying process media. An end seal 210 is located at the end of the heating tube 180 within the wellbore to provide a mechanical anchor and stop for the heating cable 105 within tube 180. In particular, the conductor 14 within tube 180 is typically a heavy steel or copper having significant weight with a downward gravitational force. End seal 210 located at the downward termination point of cable 105 provides a "stop" for this downward force. In addition, end seal 210 provides a circuit connection between the conductor 18 (shown in FIG. 1) and the heating tube 180 to complete the heat tracing circuit. As explained with reference to FIG. 1, heating tube 180 includes a conductor section 14, insulating layer 16, dielectric layer 16 and tube or conduit 12. The conductor 14 and tube 12 are connected to a power supply via electrical penetrator 120 (shown in FIG. 2). Before or after installation of the heating cable 180 down the wellbore, tube 12 is filled with dielectric fluid 18. The dielectric fluid 16 fills around conductor 14 within tube 12 and is used to reduce the gravitational tension and/or compression loads in cable 180 within the wellbore. Dielectric fluid 18 improves the heat transfer characteristic from conductor 14 to conduit 12 and consequently to the production tube (not shown) through which process media, such as oil, flows toward wellhead 110. In this manner, a skin effect heating system is employed which improves the heat transfer characteristic from the heating tube to the production tube while providing a novel support mechanism to relieve the mechanical load on the cable as it is installed down the wellbore.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A skin effect heating cable positioned along a production pipe carrying process media, said heating cable comprising:

a heating tube in thermal communication with said production pipe to transfer heat thereto;

a conductor of the skin effect heating cable disposed within said heating tube, the conductor connected to a power supply to supply current to the conductor, the power supply connected to said heating tube to complete a heat tracing circuit with said conductor;

an insulating jacket positioned around the conductor;

a dielectric fluid disposed between the heating tube and the insulating jacket, the dielectric fluid surrounding the conductor to decrease the weight of the conductor, whereby decreasing the weight of the conductor reduces at least one of a gravitational tension and a compression load in the conductor, and a seal located at an end of the heating tube, the seal being mechanically coupled to the end of the heating tube to provide a liquid tight seal at the end of the heating tube, the liquid tight seal configured to seal the dielectric fluid inside the heating tube, and configured to provide a mechanical anchor point for the conductor, the seal further electrically coupling the conductor and the heating tube to complete the heat tracing circuit.

2. The heating cable of claim 1 wherein the dielectric fluid at least partially contains an organic based transformer oil.

3. The heating cable of claim 1 wherein the conductor is a high strength steel.

4. The heating cable of claim 1 wherein the conductor is a high strength copper.

5. The heating cable of claim 1 wherein the conductor is a stranded conductor having a plurality of electrically conductive strand portions.

6. A skin effect heating system for installation within a subterranean well having a wellhead and a wellbore, the heating system comprising:

a skin effect heating cable arranged in thermal communication with at least a portion of a production pipe disposed down the wellbore, the skin effect heating cable comprising:

a heating tube in thermal communication with the production pipe;

a conductor of the skin effect heating cable disposed within the heating tube, the conductor connected to a power supply through the wellhead, the power supply configured to supply current to the conductor, the power supply connected to the heating tube to complete a heat tracing circuit with the conductor;

an insulating jacket positioned around said conductor; and a dielectric fluid disposed between said heating tube and said insulating jacket, the dielectric fluid surrounding the conductor to decrease the weight of the conductor, whereby decreasing the weight of the conductor reduces at least one of a gravitational tension and a compression load in the conductor;

the production pipe carrying process media up from the subterranean well, the heating cable having a first end connected to a power supply and a second end connected to an end seal, the second end and the end seal disposed within the wellbore, the end seal being mechanically coupled to the second end of the heating cable to provide a liquid tight seal at the second end of the heating cable, and configured to provide a mechanical anchor point for the conductor, the seal further electrically coupling the conductor and the heating tube to complete a current path of the heat tracing circuit; and a mandrel arranged adjacent a top portion of the wellhead and connected to the wellhead, the heating cable wrapped around the mandrel such that the heating cable extends into the wellbore beyond the mandrel and a gravitational load of the heating cable is dispersed across the mandrel.

7. The skin effect heating system of claim 6 wherein the wellhead further comprises a wellhead cap, the heating system further comprising an electrical penetrator disposed through the wellhead cap and disposed between the power supply and the conductor.

8. The skin effect heating system of claim 6 wherein the wellhead further comprises a wellhead cap, the mandrel connected to the wellhead cap.

9. The skin effect heating system of claim 6 wherein the mandrel has a substantially cylindrical shape.

10. The skin effect heating system of claim 6 further comprising: a tube hanger connected to the wellhead through which the heating cable extends; a tube connector having a first and second ends, the first end connected to the tube hanger, the second end connected to the heating tube.

11. The skin effect heating system of claim 6 wherein the end seal electrically connects the conductor and the heating tube to complete a heat tracing circuit.

12. A method for installing a skin effect heating cable within a well comprising:

placing an insulated conductor within a tube;

forming an electrically conductive connection between the conductor and the tube;

inserting the tube containing the conductor into a wellbore;

sealing a distal end of the heating cable using a seal, the seal being mechanically coupled to the distal end of the heating tube to provide a liquid tight seal at the distal end of the heating cable, and configured to provide a mechanical anchor point for the conductor, the seal further electrically coupling the conductor and the tube to complete a current path of the heat tracing circuit; and filling the tube with a dielectric fluid, the dielectric fluid surrounding the conductor sufficiently to decrease the weight of the conductor, whereby decreasing the weight of the conductor reduces at least one of a gravitational tension and a compression load in the conductor.

13. The method of claim 12 further comprising installing the tube along at least a portion of a production pipe within the wellbore.

14. The method of claim 12 wherein the wellbore includes a top portion located at the surface of the well, the method further comprising connecting the conductor and the tube to a power supply through an electrical penetrator positioned near the top of the wellbore.

15. The method of claim 12 wherein the wellbore includes a top portion located at the surface of the well, the method further comprising wrapping the cable around a mandrel located near the top of the well.

* * * * *